US009719151B2

(12) United States Patent
Tanaka et al.

(10) Patent No.: US 9,719,151 B2
(45) Date of Patent: Aug. 1, 2017

(54) STEEL SHEET, PLATED STEEL SHEET, AND METHOD FOR PRODUCING THE SAME

(71) Applicant: NIPPON STEEL & SUMITOMO METAL CORPORATION, Tokyo (JP)

(72) Inventors: Hiroyuki Tanaka, Tokyo (JP); Kunio Hayashi, Tokyo (JP); Toshio Ogawa, Tokyo (JP); Koichi Goto, Tokyo (JP); Kazuaki Nakano, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 411 days.

(21) Appl. No.: 14/378,274

(22) PCT Filed: Feb. 7, 2013

(86) PCT No.: PCT/JP2013/052836
§ 371 (c)(1),
(2) Date: Aug. 12, 2014

(87) PCT Pub. No.: WO2013/121963
PCT Pub. Date: Aug. 22, 2013

(65) Prior Publication Data

US 2015/0004433 A1 Jan. 1, 2015

(30) Foreign Application Priority Data

Feb. 17, 2012 (JP) ..... 2012-032591

(51) Int. Cl.
*C21D 8/02* (2006.01)
*C21D 9/46* (2006.01)
(Continued)

(52) U.S. Cl.
CPC ..... *C21D 8/0263* (2013.01); *C21D 8/0205* (2013.01); *C21D 8/0226* (2013.01);
(Continued)

(58) Field of Classification Search
CPC ..... C21D 2211/003; C21D 2211/004; C21D 2211/005; C22C 29/06; C22C 32/0052
See application file for complete search history.

(56) References Cited

U.S. PATENT DOCUMENTS 4,854,976 A * 8/1989 Era ..... C22C 38/00 148/547
2006/0113012 A1 6/2006 Okamoto et al.
(Continued)

FOREIGN PATENT DOCUMENTS

CN 101163807 A 4/2008
CN 101443467 A 5/2009
(Continued)

OTHER PUBLICATIONS

International Search Report issued in PCT/JP2013/052836 dated May 7, 2013.
(Continued)

*Primary Examiner* — Scott Kastler
*Assistant Examiner* — Vanessa Luk
(74) *Attorney, Agent, or Firm* — Birch, Stewart, Kolasch & Birch, LLP

(57) ABSTRACT

A steel sheet includes, by mass %: C: 0.020% to 0.080%; Si: 0.01% to 0.10%; Mn: 0.80% to 1.80%; and Al: more than 0.10% and less than 0.40%; and further includes: Nb: 0.005% to 0.095%; and Ti: 0.005% to 0.095%, in which a total amount of Nb and Ti is 0.030% to 0.100%, and the steel sheet includes, as a metallographic structure, ferrite, bainite, and other phases, an area fraction of the ferrite is 80% to 95%, an area fraction of the bainite is 5% to 20%, a total fraction of the other phases is less than 3%, a tensile strength is 590 MPa or more, and a fatigue strength ratio as a fatigue strength to the tensile strength is 0.45 or more.

10 Claims, 4 Drawing Sheets

(51) Int. Cl.

| | |
|---|---|
| ***C22C 38/48*** | (2006.01) |
| ***C22C 38/50*** | (2006.01) |
| ***C23C 2/02*** | (2006.01) |
| ***C23C 2/06*** | (2006.01) |
| ***C23C 2/28*** | (2006.01) |
| ***C22C 38/14*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/16*** | (2006.01) |
| ***C22C 38/18*** | (2006.01) |
| ***C22C 38/22*** | (2006.01) |
| ***C22C 38/26*** | (2006.01) |
| ***C22C 38/28*** | (2006.01) |
| ***C22C 38/32*** | (2006.01) |
| ***C22C 38/44*** | (2006.01) |

(52) U.S. Cl.

CPC ..... *C21D 8/0242* (2013.01); *C21D 8/0273* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C22C 38/22* (2013.01); *C22C 38/26* (2013.01); *C22C 38/28* (2013.01); *C22C 38/32* (2013.01); *C22C 38/44* (2013.01); *C22C 38/48* (2013.01); *C22C 38/50* (2013.01); *C23C 2/02* (2013.01); *C23C 2/06* (2013.01); *C23C 2/28* (2013.01); *C21D 9/46* (2013.01); *C21D 2211/001* (2013.01); *C21D 2211/002* (2013.01); *C21D 2211/003* (2013.01); *C21D 2211/005* (2013.01); *C21D 2211/008* (2013.01); *C21D 2211/009* (2013.01); *Y10T 428/12799* (2015.01)

(56) References Cited

U.S. PATENT DOCUMENTS

| | | | | |
|---|---|---|---|---|
| 2009/0297872 | A1 | 12/2009 | Takahashi et al. | |
| 2011/0023991 | A1 | 2/2011 | Fujishiro et al. | |
| 2012/0012231 | A1 * | 1/2012 | Murakami | C21D 8/0405 148/504 |
| 2012/0152411 | A1 | 6/2012 | Morimoto et al. | |

FOREIGN PATENT DOCUMENTS

| | | | | |
|---|---|---|---|---|
| CN | 101622370 | A | 1/2010 | |
| CN | 101965414 | A | 2/2011 | |
| CN | 102341518 | A | 2/2012 | |
| EP | 2119803 | A1 | 11/2009 | |
| EP | 2130938 | A1 | 12/2009 | |
| JP | 07-090483 | A | 4/1995 | |
| JP | 2004-204326 | A | 7/2004 | |
| JP | 2004-225109 | A | 8/2004 | |
| JP | 2006-152341 | A | 6/2006 | |
| JP | 2006-161111 | A | 6/2006 | |
| JP | 2009-299136 | A | 12/2009 | |
| JP | 2010-159466 | A | 7/2010 | |
| JP | 4772932 | B2 * | 9/2011 | C21D 8/0226 |
| JP | 2012-1775 | A | 1/2012 | |
| JP | 2012-1776 | A | 1/2012 | |
| WO | WO 2011/025042 | A1 | 3/2011 | |

OTHER PUBLICATIONS

Written Opinion of the International Searching Authority issued in PCT/JP2013/052836 dated May 7, 2013.

Taiwanese Office Action dated Aug. 12, 2014, issued in Taiwanese Patent Application No. 102105252.

Chinese Office Action and Search Report for Chinese Application No. 201380009034.0, dated Sep. 8, 2015, with an English translation of the Search Report only.

Extended European Search Report for European Application No. 13749448.0, dated Oct. 29, 2015.

* cited by examiner

STEEL SHEET, PLATED STEEL SHEET, AND METHOD FOR PRODUCING THE SAME

TECHNICAL FIELD OF THE INVENTION

The present invention relates to a high-strength steel sheet and a plated steel sheet which have excellent fatigue properties, ductility, and hole expansibility, and further, excellent collision properties, which is suitable for a steel sheet for a vehicle, particularly suitable for a suspension part, and a method for producing the same.

Priority is claimed on Japanese Patent Application No. 2012-032591, filed on Feb. 17, 2012, the content of which is incorporated herein by reference.

RELATED ART

In recent years, in order for automakers to cope with the tightening of $CO_2$ emission regulations in Europe in 2012, fuel economy regulations in Japan in 2015, and stricter collision regulations in Europe, high-strengthening of steel to be used has rapidly progressed to improve fuel economy through a decrease in the weight of a vehicle body and improve collision safety. Such a high-strength steel sheet is called a "high strength steel sheet", and orders of steel sheets mainly having a tensile strength of 440 MPa to 590 MPa, and recently more than 590 MPa, tends to increase every year.

Among the high strength steel sheet, excellent fatigue properties are required for a suspension part such as a chassis frame from the viewpoint of the application portion thereof, and further, ductility, and hole expansibility are required from the viewpoint of the shape of the parts. On the other hand, a hot-rolled steel sheet which is thick and has a thickness of 2.0 mm or more is mainly used for the suspension part, and the quality is guaranteed by selecting a thick material for securing rigidity. Thus, thinning a suspension part is being delayed compared to vehicle body parts or the like. Accordingly, when reduction in the thickness of the suspension part is promoted, a corrosion thinning area thereof is reduced, and thus, it is expected that an application to a hot-dip galvanized steel sheet having high corrosion resistance from the current hot-rolled steel sheet will be made.

Generally, it is considered that when a fatigue strength ratio obtained by dividing fatigue strength by tensile strength is 0.45 or more, fatigue properties are excellent. In addition, it is considered that when the product of tensile strength and total elongation is 17000 MPa·% or more, ductility is excellent, and when hole expansion ratio is 80% or more at a tensile strength of 590 MPa class, hole expansibility is excellent. It is considered that when a yield ratio obtained by dividing yield strength by tensile strength is 0.80 or more, collision resistance is excellent.

Generally, when tensile strength increases, yield strength also increases. Thus, ductility is decreased, and further, stretch flangeability is deteriorated. In the related art, in a case of dual phase (DP) steel including a dual phase of ferrite and martensite, the ductility is excellent, but microcracks caused by local strain concentration in the vicinity of a boundary between ferrite which is a soft phase and martensite which is a hard phase easily occur or propagate, and thus, it is considered that the dual phase is a disadvantageous microstructure in hole expansibility. Accordingly, it is considered that the smaller the hardness difference between the microstructures is, the more advantageous it is in hole expansibility improvement, and thus, a steel sheet having a uniform structure such as a ferrite or bainite single phase is considered to be superior. On the other hand, since the ductility is decreased, it has been difficult to attain both ductility and hole expansibility in the related art.

In addition, generally, when tensile strength increases, fatigue strength also tends to increase. However, when a material having a higher strength is used, a fatigue strength ratio decreases. In addition, the fatigue strength ratio is obtained by dividing the fatigue strength of a steel sheet by tensile strength. Generally, the harder the outermost surface of a steel sheet is, the more the fatigue strength of steel is improved. Thus, the hardening of the outmost surface of the steel sheet is important to obtain excellent fatigue properties.

As a steel sheet in which both hole expansibility and ductility are attained, for example, in Patent Document 1, a steel sheet to which Al is positively added and, carbonitride forming elements such as Nb, Ti, and V are positively added has been proposed so far. However, it is necessary to add 0.4% or more of Al in a large amount to the steel sheet, and thus, the steel sheet proposed in Patent Document 1 has a problem of a higher alloy cost and deterioration in weldability. In addition, there is no description regarding fatigue properties or a yield ratio as a collision resistance index is also not disclosed.

In Patent Documents 2 and 3, high-strength steel sheets having excellent hole expansibility to which Nb and Ti are positively added have been proposed. However, since Si is positively added to the high-strength steel sheets proposed in Patent Documents 2 and 3, the steel sheets have a problem of deterioration in plating wettability. In addition, there is no description regarding fatigue properties or a yield ratio as a collision resistance index is also not disclosed.

In Patent Document 4, a steel sheet having both fatigue properties and hole expansibility to which Nb and Ti are positively added has been proposed. However, since IF steel is used as a base, the steel sheet proposed in Patent Document 4 has a problem that it is hard to achieve high-strengthening in which the tensile strength is 590 MPa or more. In addition, a yield ratio as a collision resistance index is not disclosed.

In Patent Document 5, a high-strength steel sheet in which both fatigue properties and hole expansibility are attained by controlling an inclusion in the steel has been proposed. However, since it is necessary to add a rare metal such as La or Ce to the steel sheet proposed in Patent Document 5, a higher alloy cost is required and a yield ratio as a collision resistance index is not disclosed.

In Patent Document 6, a steel sheet having excellent hole expansibility to which carbonitride forming elements such as Nb, Ti, Mo, and V are positively added has been proposed. However, the Vickers hardness of ferrite in the steel sheet proposed in Patent Document 6 has to be 0.3×TS+10 or more. Since it is assumed that the target tensile strength in the present invention is 590 MPa or higher, the Vickers hardness of ferrite has to be at least 187 Hv or more and a large amount of alloying elements (particularly, carbonitride forming elements such as C, Nb, and Ti, and ferrite stabilizing elements such as Si) has to be added to harden ferrite, and thus, a higher alloy cost is required and a yield ratio as a collision resistance index is not disclosed.

PRIOR ART DOCUMENT

Patent Document

[Patent Document 1] Japanese Unexamined Patent Application, First Publication No. 2004-204326

[Patent Document 2] Japanese Unexamined Patent Application, First Publication No. 2004-225109

[Patent Document 3] Japanese Unexamined Patent Application, First Publication No. 2006-152341

[Patent Document 4] Japanese Unexamined Patent Application, First Publication No. H7-090483

[Patent Document 5] Japanese Unexamined Patent Application, First Publication No. 2009-299136

[Patent Document 6] Japanese Unexamined Patent Application, First Publication No. 2006-161111

DISCLOSURE OF THE INVENTION

Problems to be Solved by the Invention

The present invention is to stably provide a high-strength steel sheet a plated steel sheet which have excellent fatigue properties, ductility, and hole expansibility, and further, excellent collision properties, without deterioration in productivity.

Means for Solving the Problem

The present invention is a finding obtained from an investigation that has been conducted to solve the above mentioned problems of improving fatigue properties and improvement in ductility-hole expansibility balance of a high-strength steel sheet and a plated steel sheet whose tensile strength is 590 MPa or more. That is, an appropriate microstructure is attained by optimizing the amount of alloying elements, particularly, optimizing the amount of Nb and Ti added and by positively adding Al. In addition, in an annealing process, the shape of cementite in ferrite is precisely controlled by cooling the steel to an appropriate temperature, and holding the cooled steel after heating to the maximum heating temperature. Then, the surface is hardened by carrying out appropriate skin pass rolling on the steel after the annealing. The present invention is made based on the findings in which a steel sheet having excellent fatigue properties, ductility, and hole expansibility, and further, excellent collision properties, compared to steel sheets of the related art, can be produced in the above manner, and the summary thereof is described as follows. There is no upper limit in the tensile strength of a steel sheet as a target of the present technology; however, it is difficult for the tensile strength to be more than 980 MPa in reality.

(1) According to a first aspect of the present invention, there is provided a steel sheet including, by mass %: C, 0.020% or more and 0.080% or less; Si: 0.01% or more and 0.10% or less; Mn: 0.80% or more and 1.80% or less; Al: more than 0.10% and less than 0.40%; P: limited to 0.0100% or less; S: limited to 0.0150% or less; N: limited to 0.0100% or less; Nb: 0.005% or more and 0.095% or less; Ti: 0.005% or more and 0.095% or less; and a balance including Fe and unavoidable impurities, in which a total amount of Nb and Ti is 0.030% or more and 0.100% or less, a metallographic structure of the steel sheet includes ferrite, bainite, and other phases, the other phases include a pearlite, a residual austenite, and a martensite, an area fraction of the ferrite is 80% or more and 95% or less, an area fraction of the bainite is 5% or more and 20% or less, a total fraction of the other phases is less than 3%, an equivalent circle diameter of a cementite in the ferrite is 0.003 μm or more and 0.300 μm or less, a number density of the cementite in the ferrite is 0.02 particles/$\mu m^2$ or more and 0.10 particles/$\mu m^2$ or less, a tensile strength is 590 MPa or more, and a fatigue strength ratio as a fatigue strength to the tensile strength is 0.45 or more.

(2) The steel sheet according to (1) may further include one or two more of, by mass %: Mo: 0.005% or more and 1.000% or less; W: 0.005% or more and 1.000% or less; V: 0.005% or more and 1.000% or less; B: 0.0005% or more and 0.0100% or less; Ni: 0.05% or more and 1.50% or less; Cu: 0.05% or more and 1.50% or less; and Cr: 0.05% or more and 1.50% or less.

(3) According to a second aspect of the present invention, a plated steel sheet is provided in which a plating is provided on a surface of the steel sheet according to (1) or (2).

(4) According to a third aspect of the present invention, a method is provided for producing a steel sheet including: heating a slab having a chemical composition according to (1) or (2) to 1150° C. or higher before the slab is hot-rolled; finishing finish rolling at a temperature of $Ar_3$° C. or higher; pickling a hot-rolled steel sheet which is coiled within a temperature range of 400° C. or higher and 600° C. or lower; heating the hot-rolled steel sheet within a temperature range of 600° C. or higher and $Ac_1$° C. or lower; annealing the hot-rolled steel sheet for a holding time, in which the temperature of the hot-rolled steel sheet is within the temperature range for 10 seconds or longer and 200 seconds or shorter; cooling the steel sheet to 350° C. or higher and 550° C. or lower; and cooling the steel sheet after holding the steel sheet for the holding time, in which the temperature of the hot-rolled steel sheet is within a temperature range of 350° C. or higher and 550° C. or lower for 10 seconds or longer and 500 seconds or shorter, in which the $Ar_3$° C. and the $Ac_1$° C. are a $Ar_3$ transformation temperature and a $Ac_1$ transformation temperature, respectively, obtained from expressions 1 and 2, $$Ar_3=910-325\times[C]+33\times[Si]+287\times[P]+40\times[Al]-92([Mn]+[Mo]+[Cu])-46\times([Cr]+[Ni]) \quad \text{(Expression 1)},$$

$$Ac_1=761.3+212[C]-45.8[Mn]+16.7[Si] \quad \text{(Expression 2), and}$$

elements noted in brackets represent an amount of the elements by mass %.

(5) The method for producing a steel sheet according to (4) may further include carrying out skin pass rolling on the steel sheet at an elongation ratio of 0.4% or more and 2.0% or less.

(6) According to a fourth aspect of the present invention, there is provided a method for producing a plated steel sheet including plating and then cooling the steel sheet after the annealing, the cooling, and holding according to (4) or (5).

(7) The method for producing a plated steel sheet according to (6) may further include carrying out a heat treatment within a temperature range of 450° C. or higher and 600° C. or lower for 10 seconds or longer and then cooling the steel sheet after the plating.

Effects of the Invention

According to the present invention, it is possible to provide a high-strength steel sheet and a plated steel sheet, which have a tensile strength of 590 MPa or more, a high yield ratio, and excellent fatigue properties and ductility-hole expansibility balance, and further, excellent collision properties, and which make an extremely significant contribution to the industry. Further, the present invention makes it possible to reduce the sheet thickness of a suspension part of a vehicle and thus exhibits an extremely remarkable effect that significantly contributes to a decrease in the weight of a vehicle body.

EMBODIMENTS OF THE INVENTION

Figure 1:
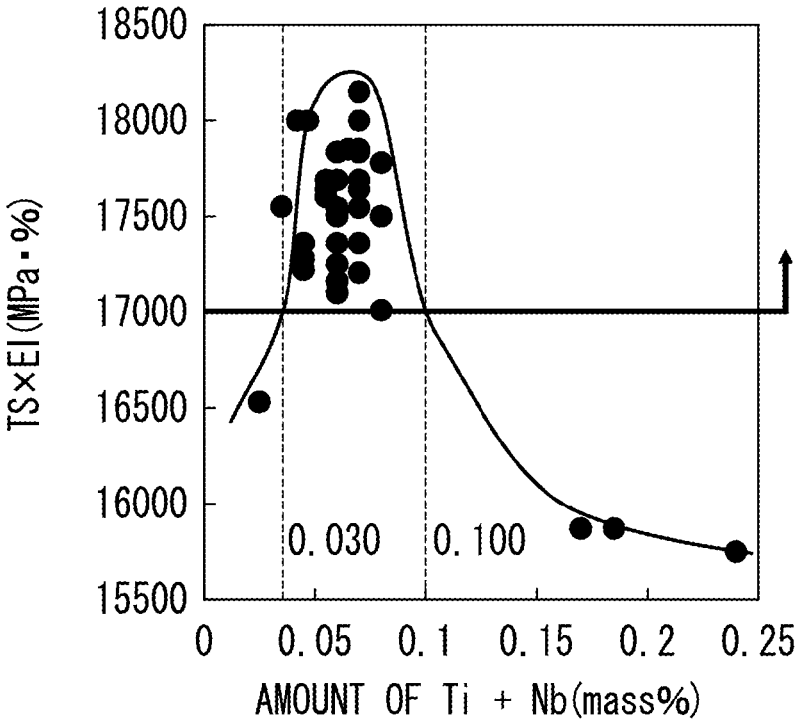
FIG. 1 is a graph showing a relationship between an average equivalent circle diameter of carbonitrides and a product of tensile strength and total elongation.

Hereinafter, the present invention will be described in detail.

First, the reasons why steel compositions are limited in the present invention will be described.

C is an element which contributes to an increase in tensile strength and yield strength, and the amount added is appropriately controlled according to a targeted strength level. In addition, C is also effective in obtaining bainite. When the amount of C is less than 0.020%, it is difficult to obtain a target tensile strength and yield strength, and thus, the lower limit is set to 0.020%. On the other hand, when the amount of C is more than 0.080%, deterioration in the ductility, hole expansibility, and weldability is caused. Thus, the upper limit is set to 0.080%. In addition, in order to stably secure the tensile strength and yield strength, the lower limit of C may preferably be 0.030% or 0.040%, and the upper limit of C may preferably be 0.070% or 0.060%.

Si is a deoxidizing element and the lower limit of the amount of Si is not determined. However, when the amount of Si is less than 0.01%, the production cost increases, and thus, the lower limit is preferably set to 0.01%. Si is a ferrite stabilizing element. In addition, Si may causes a problem of a decrease in plating wettability when hot dip galvanizing is carried out and a decrease in productivity due to the delay of alloying reaction. Therefore, the upper limit of the amount of Si is set to 0.10%. Further, in order to reduce the problem of a decrease in plating wettability and a decrease in productivity, the lower limit of Si may be set to 0.020%, 0.030%, or 0.040%, and the upper limit of Si may be set to 0.090%, 0.080%, or 0.070%.

Mn has an action of increasing the strength as an element that contributes to solid solution strengthening, and is thus effective in obtaining bainite. Therefore, it is necessary to contain 0.80% or more of Mn. On the other hand, when the amount of Mn is more than 1.80%, deterioration in hole expansibility and weldability is caused, and thus, the upper limit thereof is set to 1.80%. In addition, in order to stably obtain bainite, the lower limit of Mn may be set to 0.90%, 1.00%, or 1.10%, and the upper limit of Mn may be set to 1.70%, 1.60%, or 1.50%.

P is an impurity, and is segregated at grain boundaries and causes a decrease in the toughness of the steel sheet and deterioration in the weldability. Further, the alloying reaction becomes extremely slow during hot dip galvanizing, and the productivity is degraded. From the viewpoints, the upper limit of the amount of P is set to 0.0100%. The lower limit thereof is not particularly limited. However, since P is an element which increases strength at a low price, the amount of P is preferably set to 0.0050% or more. In order to further improve the toughness and the weldability, the upper limit of P may be limited to 0.0090% or 0.0080%.

S is an impurity and when the amount thereof is more than 0.0150%, hot cracking is induced or workability is deteriorated. Thus, the upper limit of the amount of S is set to 0.0150%. The lower limit thereof is not particularly limited, but the amount of S is preferably set to 0.0010% or more from the viewpoint of a desulfurization cost. In order to further reduce hot cracking, the upper limit of S may be limited to 0.0100% or 0.0050%.

Al is an extremely important element in the present invention. Although Al is a ferrite stabilizing element similar to Si, Al is an important element which promotes ferrite formation without a decrease in plating wettability, thereby securing ductility. In order to obtain the effect thereof, it is necessary to contain more than 0.10% of Al. In addition, when Al is excessively added, not only is the above-described effect saturated, but also an excessive increase in an alloy cost and deterioration in weldability are caused. Thus, the upper limit is set to less than 0.40%. In order to stably secure ductility, the lower limit of Al may be set to 0.15%, 0.20%, or 0.25%, and the upper limit of Al may be set to 0.35% or 0.30%.

N is an impurity. When the amount of N is more than 0.0100%, deterioration in toughness and ductility and occurrence of cracking in a steel piece are significant. Since N is effective in increasing tensile strength and yield strength, similar to C, N may be positively added as the upper limit is set to 0.0100%.

Figure 2:
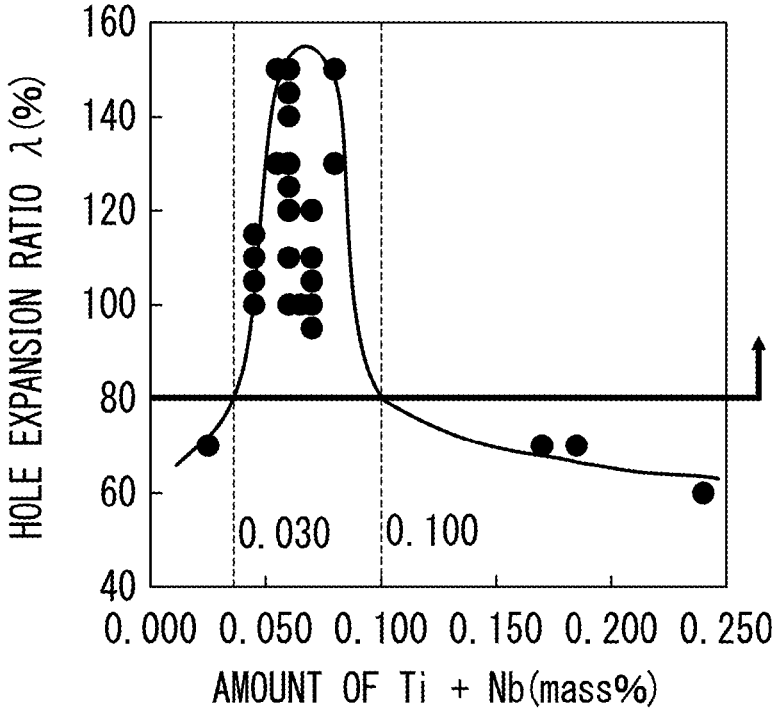
FIG. 2 is a graph showing a relationship between an average equivalent circle diameter of carbonitrides and a hole expansion ratio λ.
Figure 3:
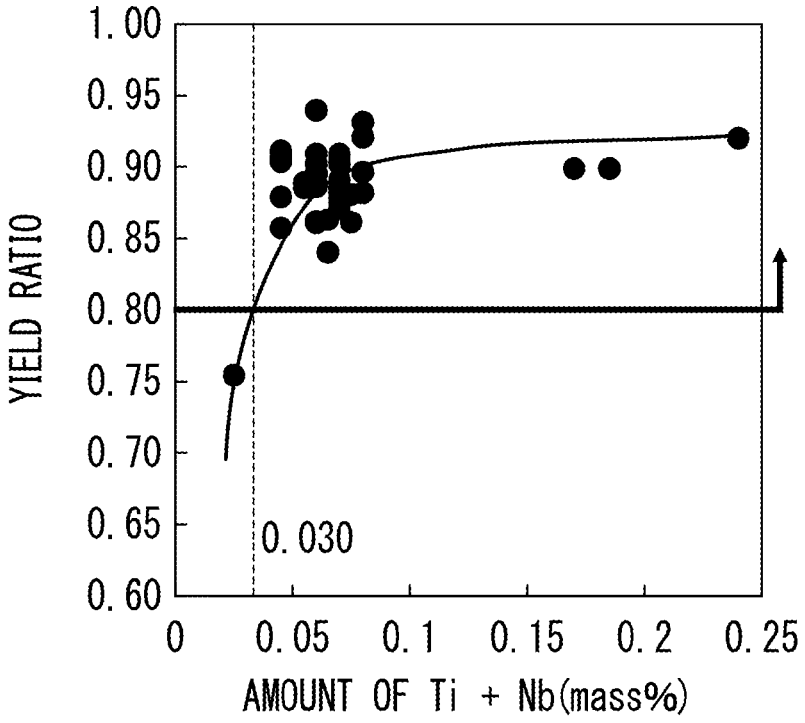
FIG. 3 is a graph showing a relationship between an average equivalent circle diameter of carbonitrides and a yield ratio.
Figure 4:
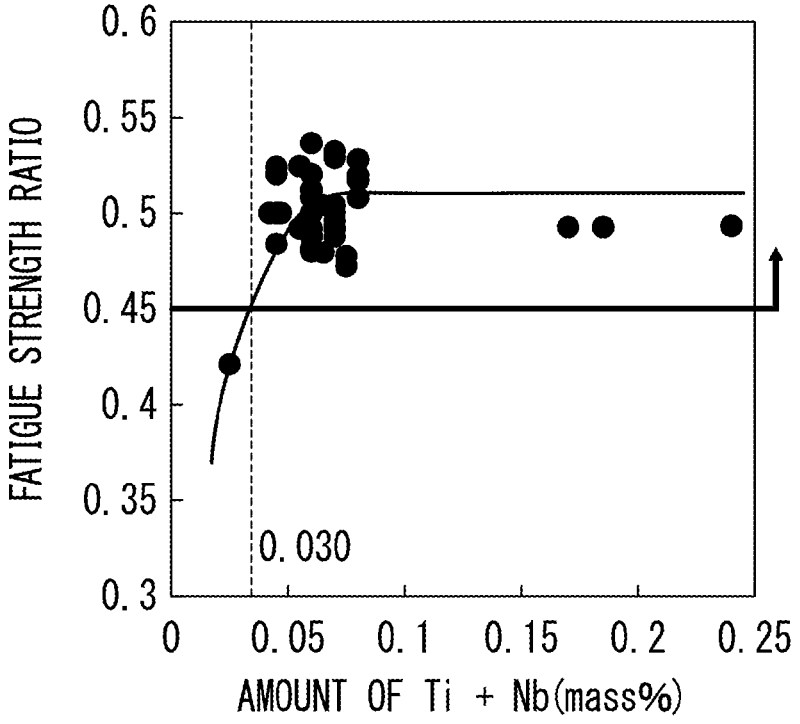
FIG. 4 is a graph showing a relationship between an average equivalent circle diameter of carbonitrides and a fatigue strength ratio.

Further, Nb and Ti are extremely important elements in the present invention. These elements are necessary when a steel sheet having excellent collision properties is prepared by forming carbonitrides so as to increase the yield strength. The precipitation strengthening of the respective elements is different. However, when both Nb and Ti are contained in total of 0.030% or more, the product of the tensile strength TS and the total elongation El as shown in FIG. 1 is excellent, and a tensile strength of 590 MPa or more can be obtained. Further, excellent hole expansibility (hole expansion ratio λ) as shown in FIG. 2 can be obtained. Moreover, it is possible to obtain a yield ratio as a collision property index of 0.80 or more and a fatigue strength ratio, as a fatigue property index of 0.45 or more as shown in FIGS. 3 and 4. The higher the fatigue strength ratio is, the more preferable it is. However, it is difficult for the fatigue strength ratio to be more than 0.60, and thus, 0.60 is the actual upper limit. Also, when Nb and Ti are added compositely, finer carbonitrides can be obtained compared to a case in which Nb and Ti are added singly, and precipitation strength is increased. Thus, it is important to add these elements compositely. In addition, the reason why the upper limit of the total amount of both Nb and Ti is set to 0.100% is not only that there is a limitation in precipitation strengthening and the strength is actually not increased any more even when Nb and Ti are added more, but also that the ductility and hole expansibility are decreased as shown in FIGS. 1 and 2. In order to stably secure the product of tensile strength and total elongation, the hole expansibility, the yield ratio, and the fatigue strength ratio, the lower limit of the total content of both Nb and Ti may be 0.032%, 0.035%, or 0.040%, and the upper limit of the total content of both Nb and Ti may be 0.080%, 0.060%, or 0.050%.

The reason why the lower limit of each of Nb and Ti is set to 0.005% is that few carbonitrides are formed when the content is less than 0.005%, the effect of an increase in yield strength is hardly obtained, and finer carbonitrides cannot be obtained. In addition, hole expansibility is decreased. The upper limit of each of Nb and Ti depends on the upper limit of the total amount of both Nb and Ti.

All of Mo, W, and V are elements which form carbonitrides, and one or two or more of these elements may be used as required. In order to obtain the effect of strength improvement, 0.005% or more of Mo, 0.005% or more of W, and 0.005% or more of V are preferably added as the lower limits. On the other hand, since excessive addition causes an increase in an alloying cost, the upper limits are preferably set to 1.000% or less of Mo, 1.000% or less of W, and 1.000% or less of V, respectively.

All of B, Ni, Cu, and Cr are elements which increase hardenability, and one or two or more of these elements may be added as required. In order to obtain the effect of strength improvement, 0.0005% or more of B, 0.05% or more of Ni, 0.05% or more of Cu, and 0.05% or more of Cr are preferably added as the lower limits. On the other hand, since excessive addition causes an increase in an alloying cost, the upper limits are preferably set to 0.0100% or less of B, 1.50% or less of Ni, 1.50% or less of Cu, and 1.50% or less of Cr, respectively.

In the high-strength steel sheet containing the above-described chemical compositions, a balance including iron as a main composition may contain unavoidable impurities mixed in a production process within the range that does not impair the properties of the present invention.

Next, the reasons why a production method is limited will be described.

A slab having the above-described composition is heated at a temperature of 1150° C. or higher. As the slab, a slab immediately after being produced by a continuous casting facility or a slab produced by an electric furnace may be used. The reason why the temperature is limited to 1150° C. or higher is to sufficiently decompose and dissolve carbonitride forming elements and carbon. In such case, the tensile strength, the product of tensile strength and total elongation, the yield ratio, and the fatigue strength ratio become excellent. In order to dissolve the precipitated carbonitrides, the temperature is preferably 1200° C. or higher. However, when the heating temperature is higher than 1280° C., the temperature is not preferable from the viewpoint of production costs, and thus, 1200° C. is preferably set as the upper limit.

In order to prevent deterioration in fatigue properties due to the fact that when a finishing temperature in hot rolling is lower than an $Ar_3$ transformation temperature, carbonitrides are precipitated and the particle size is coarsened on the surface, and the strength of the surface is significantly decreased, $Ar_3$ transformation temperature is set as the lower limit of the finishing temperature in hot rolling. The upper limit of the finishing temperature is not particularly limited, but 1050° C. is substantially set as the upper limit.

Here, $Ar_3$° C. is an $Ar_3$ transformation temperature obtained by the following Expression 1.

$$Ar_3=910-325\times[C]+33\times[Si]+287\times[P]+40\times[Al]-92\times([Mn]+[Mo]+[Cu])-46\times([Cr]+[Ni]) \quad \text{(Expression 1)}$$

Wherein, elements noted in brackets represent an amount of the elements by mass %.

A coiling temperature after finishing rolling is an extremely important production condition in the present invention. In the present invention, the control of the precipitation of carbonitrides by setting the coiling temperature to 600° C. or lower, is important at the stage of the hot-rolled steel sheet, and the properties of the present invention is not deteriorated by the past history up to that time. When the coiling temperature is higher than 600° C., carbonitrides on the hot-rolled steel sheet are precipitated, sufficient precipitation strengthening after annealing cannot be attained, and thus, the tensile strength, the yield ratio, and the fatigue properties are deteriorated. Therefore, 600° C. is set as the upper limit. Further, when the coiling temperature is 600° C. or lower, bainite is obtained, and it is effective in improving the strength. In addition, when the coiling temperature is lower than 400° C., a sufficient amount of ferrite cannot be obtained, and the ductility, the product of tensile strength and total elongation, and the hole expansibility are decreased. Thus, 400° C. is set as the lower limit.

Since a hot-rolled steel sheet is used as a base material for the steel sheet of the present invention, the steel sheet is then subjected to typical pickling and annealing without cold rolling by a tandem rolling mill after hot rolling. However, rolling such as temper rolling (reduction of about 0.4% to 10%) may be carried out before annealing for the purpose of improving the shape to avoid meandering or the like when the steel sheet passes through a continuous annealing facility.

The annealing is preferably carried out by the continuous annealing facility to control the heating temperature and the heating time. The maximum heating temperature in the annealing is an extremely important production condition in the present invention. The lower limit of the maximum heating temperature is set to 600° C., and the upper limit is set to an $Ac_1$ transformation temperature. When the maximum heating temperature is lower than 600° C., the precipitation of carbonitrides is insufficient in the annealing, and the tensile strength and the yield strength are decreased. Further, the fatigue properties are decreased. On the other hand, when the maximum heating temperature is higher than the $Ac_1$ transformation temperature, the coarsening of the carbonitrides and the transformation from ferrite to austenite occur, and insufficient precipitation strengthening is attained. Thus, the $Ac_1$ transformation temperature is set as the upper limit.

Here, $Ac_1$° C. is an $Ac_1$ transformation temperature obtained by the following Expression 2.

$$Ac_1=761.3+212[C]-45.8[Mn]+16.7[Si] \quad \text{(Expression 2)}$$

Wherein, elements noted in brackets represent an amount of the elements by mass %.

A holding time at the maximum heating temperature in the annealing is an extremely important production condition in the present invention. The holding time of the steel sheet within the temperature range of 600° C. to the $Ac_1$ transformation temperature is set to 10 seconds to 200 seconds. This is because when the holding time of the steel sheet at the maximum heating temperature is shorter than 10 seconds, the precipitation of carbonitrides is insufficient, and sufficient precipitation strengthening cannot be attained.

Thus, a decrease in the tensile strength, the yield strength, and the fatigue strength is caused. On the other hand, when the holding time of the steel sheet at the maximum heating temperature is long, a decrease in the productivity is caused, and also, coarsening of the carbonitrides is caused. Thus, sufficient precipitation strengthening cannot be attained, and the tensile strength and the yield strength are decreased. Further, the fatigue strength is decreased. Thus, 200 seconds are set as the upper limit.

Figure 5:
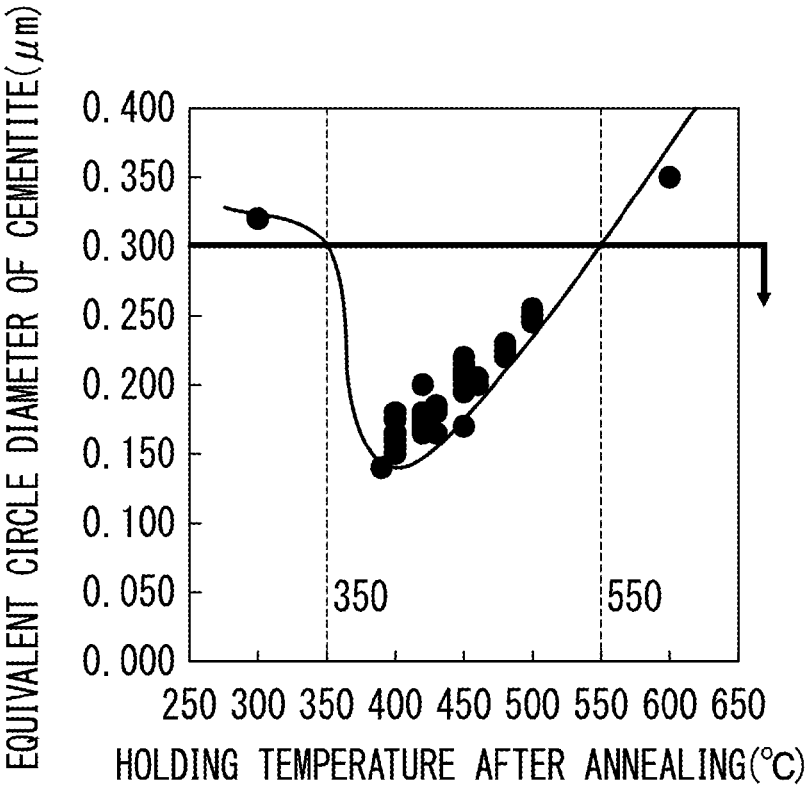
FIG. 5 is a graph showing a relationship between a holding temperature after annealing and an equivalent circle diameter of cementite in ferrite.
Figure 6:
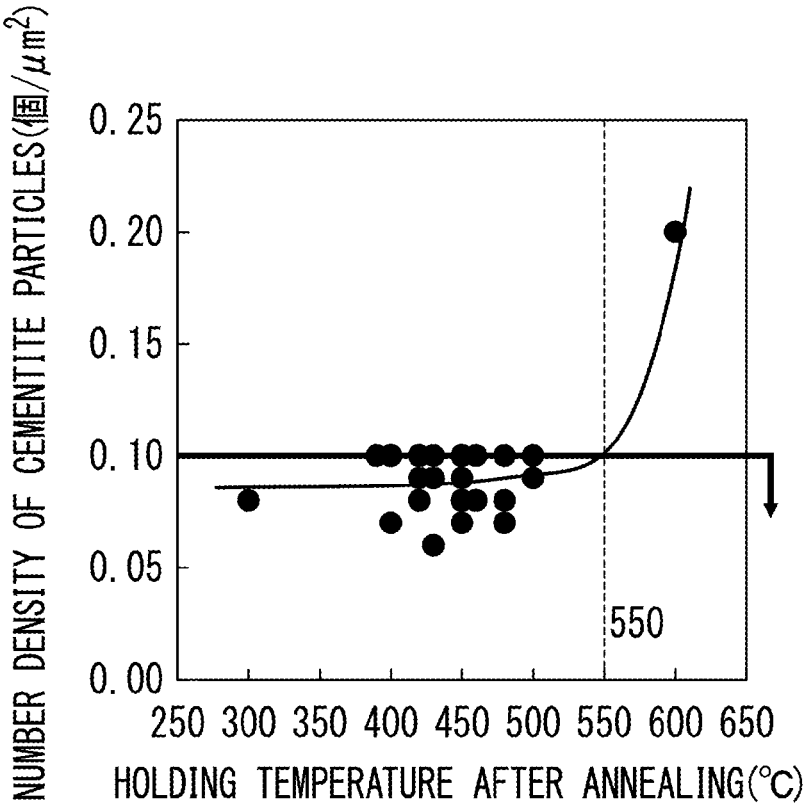
FIG. 6 is a graph showing a relationship between a holding temperature after annealing and a number density of cementite in ferrite.
Figure 7:
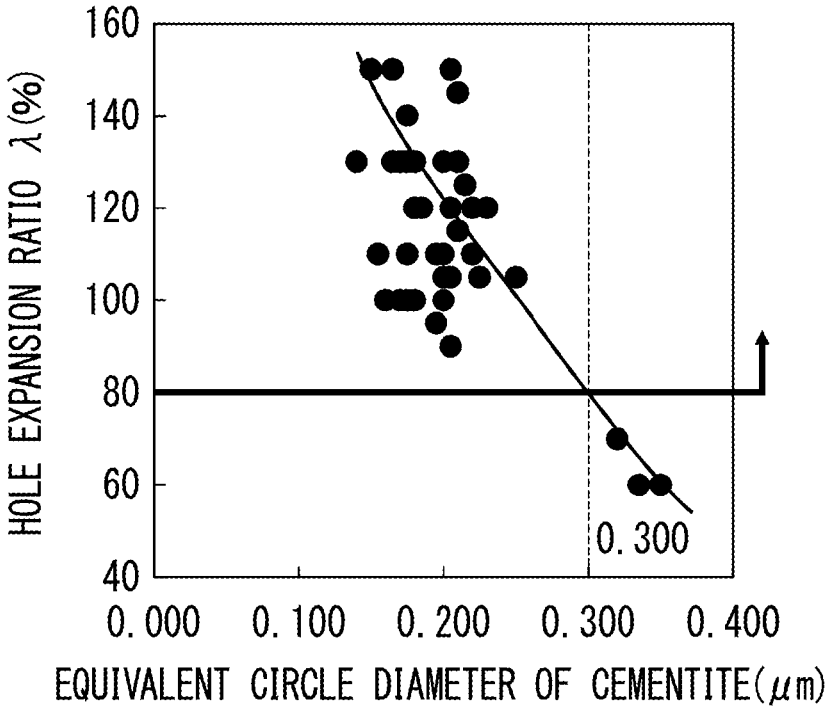
FIG. 7 is a graph showing a relationship between an equivalent circle diameter of cementite in ferrite and a hole expansion ratio λ.
Figure 8:
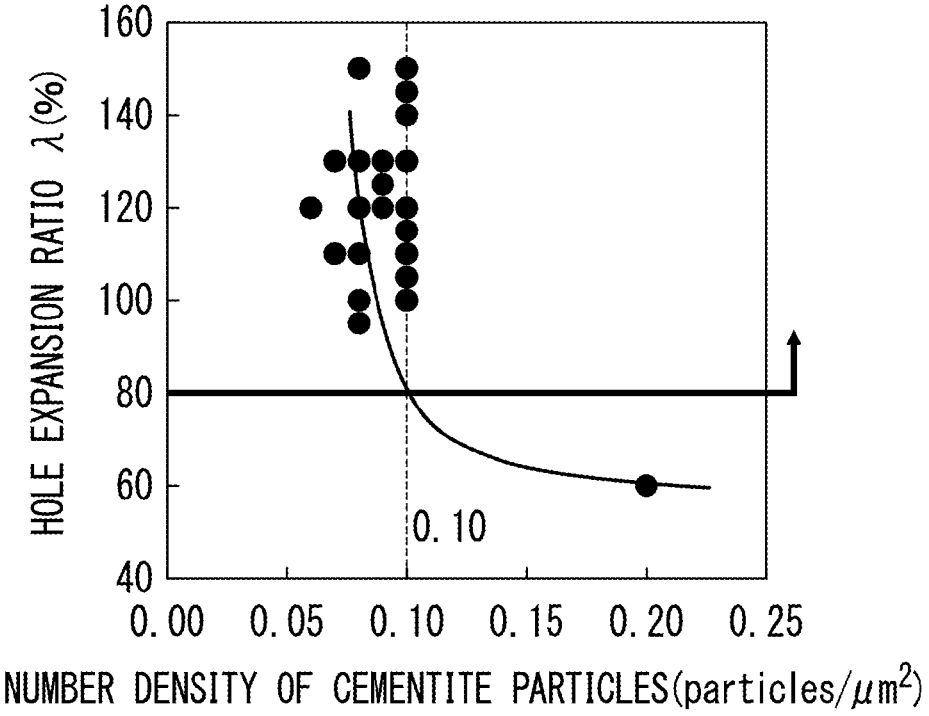
FIG. 8 is a graph showing a relationship between a number density of cementite in ferrite and a hole expansion ratio λ.

After the annealing, the steel sheet is cooled to 350° C. to 550° C. and held the steel sheet within the above temperature range for 10 seconds to 500 seconds. The holding in the above temperature range is extremely important in the present invention, and the hole expansibility can be improved through the precipitation of fine cementite in ferrite as far as possible by holding the steel sheet at 350° C. to 550° C. after the annealing. When the holding temperature is higher than 550° C., the cementite in the ferrite is coarsened as shown in FIG. 5, the number density of the cementite in the ferrite is also increased as shown in FIG. 6, and thus, the hole expansibility is deteriorated as shown in FIGS. 7 and 8. Therefore, the upper limit is set to 550° C. In addition, when the holding temperature is set to lower than 350° C., the effect of precipitating fine cementite in the ferrite is reduced, and thus, the lower limit is set to 350° C. When the holding time within the above temperature range is longer than 500 seconds, the cementite in the ferrite is coarsened, the number density thereof is increased, and the hole expansibility is deteriorated. Thus, the upper limit is set to 500 seconds. When the holding time within the above temperature range is shorter than 10 seconds, the effect of precipitating fine cementite in ferrite cannot be obtained sufficiently, and thus, the lower limit is set to 10 seconds. After the holding of the steel sheet, the steel sheet is cooled to room temperature.

In addition, the cooling rate after the annealing may be appropriately controlled through spraying of a coolant, such as water, air blowing, or forcible cooling using mist or the like.

When the steel sheet is subjected to hot dip galvanizing or galvannealing after the cooling after the annealing is carried out, the composition of zinc plating is not particularly limited, and in addition to Zn, Fe, Al, Mn, Cr, Mg, Pb, Sn, Ni, and the like may be added as required. The plating may be carried out as a separate process from annealing, but is preferably carried out through a continuous annealing-hot dip galvanizing line in which annealing, cooling and plating are continuously carried out from the viewpoint of the productivity. When the following alloying treatment is not carried out, the steel sheet is cooled to room temperature after the plating.

When an alloying treatment is carried out, it is preferable that the alloying treatment is carried out within a temperature range of 450° C. to 600° C. after the plating, and then, the steel sheet be cooled to room temperature. This is because alloying does not sufficiently proceed at a temperature of lower than 450° C., and alloying excessively proceeds at a temperature of higher than 600° C. such that the plated layer is embrittled to cause a problem of exfoliation of the plated layer during working such as pressing or the like. When an alloying treatment time is shorter than 10 seconds, alloying does not sufficiently proceed, and thus, 10 seconds or longer is preferable. In addition, the upper limit of the alloying treatment time is not particularly limited, but preferably within 100 seconds from the viewpoint of productivity.

From the viewpoint of productivity, it is preferable that an alloying treatment furnace be provided continuously to the continuous annealing-hot dip galvanizing line to carry out annealing, cooling, plating and an alloying treatment, and cooling in a continuous manner.

Examples of the plated layer shown in examples include hot dip galvanizing and galvannealing, but electrogalvanizing is also included.

Skin pass rolling is extremely important in the present invention. The skin pass rolling has the effects of not only correcting the shape and securing surface properties, but also improving the fatigue properties by hardening the surface. Thus, the skin pass rolling is preferably carried out in a range of an elongation ratio of 0.4% to 2.0%. The reason why the lower limit of the elongation ratio of the skin pass rolling is set to 0.4% is that when the elongation ratio is less than 0.4%, sufficient improvement in the surface roughness and working hardening of the only surface are not attained, and the fatigue properties are not improved. Thus, 0.4% is set as the lower limit. On the other hand, when the skin pass rolling is carried out at an elongation ratio of more than 2.0%, the steel sheet is excessively worked and hardened to deteriorate the press formability, and thus, 2.0% is set as the upper limit.

Next, a metallographic structure will be described.

The microstructure of the steel sheet obtained by the present invention is composed of mainly ferrite and bainite. When the area fraction of ferrite is less than 80%, the fraction of bainite is increased and sufficient ductility cannot be obtained. Thus, the lower limit of the area fraction of ferrite is set to 80% or more. When the area fraction of ferrite is more than 95%, the tensile strength is decreased, and thus the upper limit of the area fraction of ferrite is set to 95% or less. However, the cementite in the ferrite is not converted into an area.

Bainite contributes to high-strengthening. However, when the amount of bainite is excessive, a decrease in the ductility is caused, and thus, the lower limit is set to 5% and the upper limit is set to 20%.

In addition, as other phases, there are pearlite, residual austenite, and martensite, and when a total fraction (area fraction or volume ratio) of these compositions is 3% or more, the yield strength is decreased and it is difficult to increase the yield ratio to 0.80 or more. Therefore, the total fraction of the pearlite, residual austenite, and martensite is set to less than 3%.

The microstructure may be observed with an optical microscope by collecting a sample having a sheet thickness cross section, which is parallel in a rolling direction, as an observation surface, polishing the observation surface, and carrying out nital, and as required, La Pera etching. In the observation of the microstructure, a portion which is at a depth of ¼ of the sample collected from an arbitrary position of the steel sheet in the thickness direction was imaged at a magnification of 1000 times in a range of 300×300 μm. By binarizing the image of the microstructure obtained by the optical microscope to white and black and analyzing the image, a total area fraction of any one or two or more of pearlite, bainite, and martensite can be obtained as an area fraction of phases other than the ferrite. It is difficult to distinguish residual austenite from martensite with the optical microscope, but the volume ratio of the residual austenite can be measured by an X-ray diffraction method. The area fraction obtained from the microstructure is the same as the volume ratio.

The shape of cementite in ferrite is extremely important in the present invention. When the equivalent circle diameter of cementite in ferrite is more than 0.300 μm, there is a high possibility of cementite being a starting point of cracking in a hole expansion test, and the hole expansibility is deteriorated. Thus, the upper limit is set to 0.300 μm. The lower limit is set to 0.003 μm in terms of accuracy in measurement. In addition, when the number density of the cementite having the equivalent circle diameter in ferrite is more than 0.10 particles/$\mu m^2$, the cementite in the ferrite may be a starting point of cracking in a hole expansion test, and thus, the hole expansibility is deteriorated. Thus, the upper limit is set to 0.10 particles/$\mu m^2$. It is difficult to control the number density of cementite in ferrite to be 0.02 particles/$\mu m^2$, and thus, the lower limit is set to 0.02 particles/$\mu m^2$. The equivalent circle diameter and the number density of the cementite in the ferrite were determined from the observation result of 100 view fields obtained by preparing an extraction replica sample which was extracted from a portion which is at a depth of ¼ of a sample collected from an arbitrary position of the steel sheet in the thickness direction, and observing cementite in ferrite with a transmission type electron microscope (TEM) at a magnification of 10000 times in a range of 10×10 μm. As for a count method, 100 view fields were arbitrarily selected.

A test method of each mechanical property will be described below. A tensile test sample according to JIS Z 2201 No. 5 was taken from a steel sheet after being produced considering the width direction (referred to as the TD direction) as the longitudinal direction, and the tensile properties in the TD direction were evaluated according to JIS Z 2241. The fatigue strength was evaluated with the Schenk type plane bending fatigue testing machine according to JIS Z 2275. The stress load at this time was set at a vibration frequency of reversed testing of 30 Hz. In addition, according to the above description, a value obtained by dividing the fatigue strength at the cycle of $10^7$ measured by the plane bending fatigue test by the tensile strength measured by the above-described tensile test was set to a fatigue strength ratio. The hole expansibility was evaluated according to Japan Iron and Steel Federation Standard JFST 1001. Each of the obtained steel sheets was cut to 100 mm×100 mm size pieces and then punched to have a hole with a diameter of 10 mm with a clearance being 12% of the thickness. Then, in a state in which wrinkles were suppressed with a wrinkle suppressing force of 88.2 kN using a die with an inner diameter of 75 mm, a 60° conical punch was forced through the hole to measure a hole diameter in a fracture initiation limit. A limit hole expansion ratio [%] was obtained from the following Expression 3, and the hole expansibility was evaluated based on the limit hole expansion ratio.

$$\text{Limit hole expansion ratio } \lambda[\%]=\{(D_f-D_0)/D_0\}\times 100 \quad \text{(Expression 3)}$$

Here, $D_f$ represents a hole diameter [mm] at the time of fracture initiation, and $D_0$ represents an initial hole diameter [mm]. In addition, plating adhesion is evaluated according to JIS H 0401 by visually observing a surface state of a plating film at a portion bent by a bending test.

EXAMPLES

Steel having the compositions shown in Table 1 were melted and cast to form slabs. Steel sheets were produced using the obtained slabs under the conditions shown in Tables 2-1 and 2-2. "[-]" in Table 1 indicates that the analyzed value of a composition is less than a detection limit. In addition, calculation values in Table 1, $Ar_3$ [° C.] and $Ar_1$ [° C.] are also shown.

A tensile test sample according to JIS Z 2201 No. 5 was taken from a steel sheet after being produced considering the width direction (referred to as the TD direction) as the longitudinal direction, and the tensile properties in the TD direction were evaluated according to JIS Z 2241. The fatigue strength was evaluated with the Schenk type plane bending fatigue testing machine according to JIS Z 2275. The stress load at this time was set at a vibration frequency of reversed testing of 30 Hz. In addition, according to the above description, a value obtained by dividing the fatigue strength at the cycle of $10^7$ measured by the plane bending fatigue test by the tensile strength measured by the above-described tensile test was set to a fatigue strength ratio. The hole expansibility was evaluated according to Japan Iron and Steel Federation Standard JFST 1001. Each of the obtained steel sheets was cut to 100 mm×100 mm size pieces and then punched to have a hole with diameter of 10 mm with a clearance being 12% of the thickness. Then, in a state in which wrinkles were suppressed with a wrinkle suppressing force of 88.2 kN using a die with an inner diameter of 75 mm, a 60° conical punch was forced through the hole to measure a hole diameter in a fracture initiation limit. A limit hole expansion ratio [%] was obtained from the following Expression 3, and the hole expansibility was evaluated based on the limit hole expansion ratio.

$$\text{Limit hole expansion ratio } \lambda[\%]=\{(D_f-D_0)/D_0\}\times 100 \quad \text{(Expression 3)}$$

Here, $D_f$ represents a hole diameter [mm] at the time of fracture initiation, and $D_0$ represents an initial hole diameter [mm]. In addition, plating adhesion is evaluated according to JIS H 0401 by visually observing a surface state of a plating film at a portion bent by a bending test.

The microstructure of the sheet thickness cross section of the steel sheet was observed by the above-described manner, and the area fraction of bainite was obtained as a total area fraction of ferrite and phases other than ferrite.

The result is shown in Tables 3-1 and 3-2. In the present invention, the fatigue properties were evaluated to be excellent in a case in which a fatigue strength ratio as a fatigue property index was 0.45 or more. The ductility was evaluated to be excellent in a case in which the product of tensile strength TS [MPa] and total elongation El [%], that is, TS×El [MPa·%], as a ductility index was 17000 [MPa·%] or more. The hole expansibility was evaluated to be excellent in a case in which a hole expansion ratio λ [%] as a hole expansibility index was 80% or more. The collision properties were evaluated to be excellent in a case in which a yield ratio as a collision property index was 0.80 or more.

As shown in Tables 3-1 and 3-2, the result is that it is possible to obtain a high-strength steel sheet having excellent fatigue strength and collision properties, and excellent ductility-hole expansibility balance, a hot-dip galvanized steel sheet, and a galvannealed steel sheet by subjecting steel having the chemical compositions of the present invention to hot rolling and annealing under appropriate conditions.

On the other hand, for Steel No. M, since the amount of C is large, the ductility and the hole expansibility are decreased.

For Steel No. N, since the amount of C is small, the area fraction of bainite is reduced, the tensile strength is decreased, and the yield ratio and the product of tensile strength and total elongation are decreased.

For Steel No. O, since the amount of Si is large, the area fraction of bainite is reduced, the tensile strength is decreased, and the product of tensile strength and total elongation is decreased.

For Steel No. P, since the amount of Mn is small, the area fraction of bainite is reduced, the tensile strength is decreased, and the product of tensile strength and total elongation is decreased.

For Steel No. Q, since the amount of Mn is large, the area fraction of bainite is increased, and the tensile strength is increased. However, the ductility is decreased, the product of tensile strength and total elongation is decreased, and the hole expansibility is also decreased.

For Steel No. R, since the amount of Al is small, the area fraction of bainite is increased, the ductility is decreased, the product of tensile strength and total elongation is decreased, and the hole expansibility is also decreased.

For Steel No. S, since the amount of Al is large, the area fraction of bainite is reduced, the tensile strength is decreased, and the product of tensile strength and total elongation is decreased.

For Steel No. T, since the total amount of Ti and Nb is small, the tensile strength is decreased, the yield ratio, the product of tensile strength and total elongation are decreased. Also, the fatigue strength and the hole expansibility are decreased.

For Steel No. U, since the amount of Ti is small, the yield ratio and the hole expansibility are decreased.

For Steel No. V, since the amount of Ti is large, the ductility is decreased, the product of tensile strength and total elongation is decreased, and the hole expansibility is also decreased.

For Steel No. W, since the amount of Nb is small, the yield ratio and the hole expansibility are decreased.

For Steel No. X, since the amount of Nb is large, the ductility is decreased, the product of tensile strength and total elongation is decreased, and the hole expansibility is also decreased.

For Steel No. Y, since Nb is not added, the tensile strength, the yield ratio and the fatigue strength ratio are decreased.

For Steel No. Z, since the total amount of Ti and Nb is large, the ductility is decreased, the product of tensile strength and total elongation is decreased, and the hole expansibility is also decreased.

For Steel No. AA, since the amount of Ti and Nb is large, the ductility is decreased, the product of tensile strength and total elongation is decreased, and the hole expansibility is also decreased.

For Production No. 3, since the heating temperature is low during the hot rolling, and the amount of precipitation strengthening by carbonitrides is small, the tensile strength is decreased, the product of tensile strength and total elongation is decreased, and the yield ratio and the fatigue strength ratio are also decreased.

For Production No. 6, since the holding temperature after heating the steel sheet to the maximum heating temperature in the annealing process and cooling is low, the cementite in the ferrite is coarsened and the hole expansibility is decreased.

For Production No. 9, since the holding time after heating the steel sheet to the maximum heating temperature in the annealing process and cooling is short, the cementite in the ferrite is coarsened and the hole expansibility is decreased.

For Production No. 12, the finishing temperature during the hot rolling is low and the fatigue strength is decreased due to softening of the surface of the steel sheet.

For Production No. 15, since the coiling temperature is high, and the amount of precipitation strengthening by carbonitrides is small, the tensile strength, the yield ratio, and the fatigue strength ratio are decreased.

For Production No. 18, the coiling temperature is low, the area fraction of bainite is increased, the ductility is decreased, the product of tensile strength and total elongation is decreased, and the hole expansibility is also decreased.

For Production No. 21, since the maximum heating temperature during the annealing is high and the amount of precipitation strengthening by carbonitrides is small, the tensile strength, the yield ratio, and the fatigue strength ratio are decreased.

For Production No. 24, since the maximum heating temperature during the annealing is low and the amount of precipitation strengthening by carbonitrides is small, the tensile strength, the yield ratio, and the fatigue strength ratio are decreased.

For Production No. 27, since the holding time at the maximum heating temperature during the annealing is short, and the amount of precipitation strengthening by carbonitrides is small, the tensile strength, the yield ratio, and the fatigue strength ratio are decreased.

For Production No. 30, since the holding time at the maximum heating temperature during the annealing is long and the amount of precipitation strengthening by carbonitrides is small, the tensile strength, the yield ratio, and the fatigue strength ratio are decreased.

For Production No. 31, since the holding temperature after the steel sheet is held at the maximum heating temperature and then cooled is high, the cementite in the ferrite is coarsened, and the number density is also increased, the hole expansibility is decreased.

For Production No. 34, since the coiling temperature is high, the amount of the ferrite is excessive and the tensile strength is decreased.

For Production No. 35, since the isothermal holding time after the steel sheet is held at the maximum heating temperature and then cooled is long, the cementite is coarsened, and the number density is increased, the hole expansibility is decreased.

For Production No. 38, since the coiling temperature is low, a large amount of precipitates are generated and the hole expansion ratio is low.

[Table 1]

[Table 2-1]

[Table 2-2]

[Table 3-1]

[Table 3-2]

INDUSTRIAL APPLICABILITY

According to the present invention, it is possible to provide a high-strength steel sheet and a plated steel sheet, which have a tensile strength of 590 MPa or more, a high yield ratio, and excellent fatigue properties and ductility-hole expansibility balance, and further, excellent collision properties, and which make an extremely significant contribution to the industry. Further, the present invention makes it possible to reduce the sheet thickness of a suspension part of a vehicle and thus exhibits an extremely remarkable effect that significantly contributes to a decrease in the weight of a vehicle body.

TABLE 1

| STEEL No. | C % | Si % | Mn % | P % | S % | Al % | N % | Ti % | Nb % | Ti + Nb % | Mo % |
|---|---|---|---|---|---|---|---|---|---|---|---|
| A | 0.050 | 0.05 | 1.50 | 0.0085 | 0.0022 | 0.35 | 0.0033 | 0.050 | 0.020 | 0.070 | — |
| B | 0.045 | 0.02 | 1.55 | 0.0078 | 0.0033 | 0.25 | 0.0034 | 0.040 | 0.030 | 0.070 | — |
| C | 0.055 | 0.03 | 1.45 | 0.0071 | 0.0031 | 0.30 | 0.0035 | 0.030 | 0.040 | 0.070 | — |
| D | 0.050 | 0.08 | 1.40 | 0.0077 | 0.0026 | 0.20 | 0.0039 | 0.035 | 0.025 | 0.060 | — |
| E | 0.040 | 0.03 | 1.10 | 0.0082 | 0.0025 | 0.35 | 0.0034 | 0.025 | 0.030 | 0.055 | 0.10 |
| F | 0.060 | 0.04 | 1.00 | 0.0091 | 0.0030 | 0.35 | 0.0040 | 0.020 | 0.025 | 0.045 | — |
| G | 0.070 | 0.03 | 0.90 | 0.0073 | 0.0029 | 0.30 | 0.0035 | 0.040 | 0.030 | 0.070 | — |
| H | 0.035 | 0.02 | 1.30 | 0.0080 | 0.0028 | 0.35 | 0.0036 | 0.045 | 0.015 | 0.060 | 0.15 |
| I | 0.050 | 0.03 | 1.05 | 0.0092 | 0.0024 | 0.35 | 0.0035 | 0.030 | 0.030 | 0.060 | — |
| J | 0.045 | 0.06 | 0.95 | 0.0073 | 0.0023 | 0.30 | 0.0041 | 0.040 | 0.020 | 0.060 | 0.10 |
| K | 0.055 | 0.07 | 0.85 | 0.0069 | 0.0024 | 0.35 | 0.0033 | 0.025 | 0.020 | 0.045 | 0.20 |
| L | 0.030 | 0.07 | 1.00 | 0.0081 | 0.0030 | 0.25 | 0.0034 | 0.030 | 0.050 | 0.080 | — |
| M | 0.150 | 0.05 | 1.20 | 0.0079 | 0.0027 | 0.30 | 0.0033 | 0.045 | 0.030 | 0.075 | — |
| N | 0.010 | 0.06 | 1.50 | 0.0077 | 0.0025 | 0.25 | 0.0028 | 0.030 | 0.030 | 0.060 | — |
| O | 0.050 | 0.30 | 1.35 | 0.0082 | 0.0028 | 0.35 | 0.0030 | 0.035 | 0.035 | 0.070 | — |
| P | 0.050 | 0.05 | 0.50 | 0.0077 | 0.0025 | 0.30 | 0.0038 | 0.055 | 0.025 | 0.080 | — |
| Q | 0.035 | 0.05 | 2.50 | 0.0075 | 0.0033 | 0.30 | 0.0027 | 0.035 | 0.030 | 0.065 | — |
| R | 0.045 | 0.02 | 1.25 | 0.0088 | 0.0025 | 0.03 | 0.0037 | 0.020 | 0.055 | 0.075 | 0.15 |
| S | 0.050 | 0.05 | 1.50 | 0.0072 | 0.0027 | 0.55 | 0.0028 | 0.030 | 0.035 | 0.065 | — |
| T | 0.050 | 0.03 | 1.20 | 0.0090 | 0.0026 | 0.30 | 0.0029 | 0.015 | 0.010 | 0.025 | — |
| U | 0.045 | 0.04 | 1.60 | 0.0073 | 0.0025 | 0.35 | 0.0033 | 0.002 | 0.040 | 0.042 | — |
| V | 0.050 | 0.04 | 1.50 | 0.0075 | 0.0030 | 0.25 | 0.0034 | 0.150 | 0.035 | 0.185 | — |
| W | 0.050 | 0.05 | 1.55 | 0.0076 | 0.0031 | 0.30 | 0.0029 | 0.045 | 0.002 | 0.047 | — |
| X | 0.055 | 0.05 | 1.35 | 0.0071 | 0.0029 | 0.30 | 0.0028 | 0.040 | 0.130 | 0.170 | — |
| Y | 0.045 | 0.03 | 1.05 | 0.0088 | 0.0028 | 0.35 | 0.0040 | 0.035 | — | 0.035 | — |
| Z | 0.050 | 0.05 | 1.15 | 0.0078 | 0.0030 | 0.25 | 0.0038 | 0.120 | 0.120 | 0.240 | — |
| AA | 0.050 | 0.02 | 1.35 | 0.0072 | 0.0032 | 0.35 | 0.0028 | 0.060 | 0.055 | 0.115 | — |

| STEEL No. | W % | V % | B % | Ni % | Cu % | Cr % | $Ar_3$ ° C. | $Ac_1$ ° C. | REMARKS |
|---|---|---|---|---|---|---|---|---|---|
| A | — | — | — | — | — | — | 774 | 704 | INVENTION STEEL |
| B | — | — | — | — | — | — | 766 | 700 | INVENTION STEEL |
| C | — | — | — | — | — | — | 774 | 707 | INVENTION STEEL |
| D | — | — | — | 0.25 | — | — | 766 | 709 | INVENTION STEEL |
| E | — | — | — | — | — | 0.20 | 795 | 720 | INVENTION STEEL |
| F | 0.15 | 0.10 | — | — | — | — | 816 | 729 | INVENTION STEEL |
| G | — | — | 0.0010 | — | 0.30 | — | 792 | 735 | INVENTION STEEL |
| H | — | — | — | — | — | — | 782 | 710 | INVENTION STEEL |
| I | 0.20 | — | 0.0015 | 0.30 | — | — | 801 | 724 | INVENTION STEEL |
| J | — | 0.15 | — | — | 0.25 | — | 792 | 728 | INVENTION STEEL |
| K | 0.30 | — | — | 0.25 | — | 0.30 | 789 | 735 | INVENTION STEEL |
| L | — | — | 0.0010 | — | 0.30 | 0.25 | 784 | 723 | INVENTION STEEL |
| M | — | — | — | — | — | — | 767 | 739 | COMPARATIVE STEEL |
| N | — | — | — | — | — | — | 783 | 696 | COMPARATIVE STEEL |
| O | — | — | — | — | — | — | 796 | 715 | COMPARATIVE STEEL |
| P | — | — | 0.0015 | — | — | — | 864 | 750 | COMPARATIVE STEEL |
| Q | — | — | — | — | — | — | 684 | 655 | COMPARATIVE STEEL |
| R | — | — | — | — | — | — | 771 | 714 | COMPARATIVE STEEL |
| S | — | — | — | — | — | — | 781 | 704 | COMPARATIVE STEEL |
| T | — | — | — | — | — | — | 799 | 717 | COMPARATIVE STEEL |
| U | — | — | — | — | — | — | 766 | 698 | COMPARATIVE STEEL |
| V | — | — | — | — | — | — | 769 | 704 | COMPARATIVE STEEL |
| W | — | — | — | — | — | — | 767 | 702 | COMPARATIVE STEEL |
| X | — | — | — | — | — | — | 784 | 712 | COMPARATIVE STEEL |
| Y | — | — | — | — | — | 0.15 | 809 | 723 | COMPARATIVE STEEL |
| Z | — | — | — | — | — | — | 802 | 720 | COMPARATIVE STEEL |
| AA | — | — | — | — | — | — | 786 | 710 | COMPARATIVE STEEL |

(NOTE 1)
THE UNDERLINED VALUES INDICATE VALUES OUTSIDE THE RANGE OF THE PRESENT INVENTION.

TABLE 2-1

| | | HOT ROLLING | | | ANNEALING | | |
|---|---|---|---|---|---|---|---|
| | | | | | MAXIMUM | | |
| STEEL No. | PRODUCTION No. | HEATING TEMPERATURE ° C. | FINISHING TEMPERATURE ° C. | COILING TEMPERATURE ° C. | HEATING TEMPERATURE ° C. | HOLDING TIME SEC | HOLDING TEMPERATURE ° C. |
| A | 1 | 1200 | 920 | 550 | 650 | 100 | 450 |
| | 2 | 1220 | 900 | 530 | 680 | 120 | 450 |
| | 3 | 1050 | 920 | 570 | 650 | 120 | 400 |

TABLE 2-1-continued

| | | | | | | | |
|---|---|---|---|---|---|---|---|
| B | 4 | 1220 | 920 | 540 | 670 | 100 | 500 |
| | 5 | 1200 | 920 | 580 | 680 | 100 | 480 |
| | 6 | 1200 | 900 | 550 | 670 | 100 | 300 |
| C | 7 | 1200 | 900 | 580 | 670 | 80 | 400 |
| | 8 | 1200 | 900 | 600 | 680 | 100 | 480 |
| | 9 | 1220 | 920 | 570 | 680 | 120 | 450 |
| D | 10 | 1200 | 930 | 580 | 670 | 80 | 430 |
| | 11 | 1250 | 910 | 550 | 670 | 120 | 420 |
| | 12 | 1200 | 750 | 550 | 700 | 100 | 400 |
| E | 13 | 1230 | 950 | 550 | 690 | 80 | 460 |
| | 14 | 1230 | 950 | 550 | 630 | 60 | 450 |
| | 15 | 1200 | 970 | 650 | 650 | 130 | 400 |
| F | 16 | 1220 | 880 | 450 | 650 | 110 | 400 |
| | 17 | 1190 | 900 | 550 | 660 | 100 | 420 |
| | 18 | 1200 | 920 | 350 | 650 | 90 | 460 |
| G | 19 | 1200 | 910 | 550 | 630 | 100 | 450 |
| | 20 | 1200 | 910 | 580 | 620 | 100 | 460 |
| | 21 | 1260 | 930 | 550 | 780 | 120 | 430 |
| H | 22 | 1240 | 900 | 570 | 650 | 90 | 420 |
| | 23 | 1250 | 900 | 530 | 650 | 80 | 420 |
| | 24 | 1200 | 950 | 470 | 570 | 100 | 400 |
| I | 25 | 1190 | 940 | 560 | 660 | 120 | 450 |
| | 26 | 1260 | 900 | 550 | 680 | 100 | 480 |
| | 27 | 1220 | 920 | 550 | 660 | 2 | 390 |

| | | | ANNEALING | | | SKIN PASS | |
|---|---|---|---|---|---|---|---|
| | STEEL No. | PRODUCTION No. | HOLDING TIME SEC | ALLOYING TREATMENT TEMPERATURE ° C. | ALLOYING TREATMENT TIME SEC | ROLLING AFTER ANNEALING ELONGATION RATIO % | ZINC PLATING |
| | A | 1 | 300 | 550 | 30 | 0.6 | PLATED |
| | | 2 | 250 | — | — | 0.8 | PLATED |
| | | 3 | 330 | 540 | 20 | 0.6 | PLATED |
| | B | 4 | 300 | — | — | 0.8 | UNPLATED |
| | | 5 | 280 | 550 | 30 | 0.6 | PLATED |
| | | 6 | 270 | — | — | 1.0 | UNPLATED |
| | C | 7 | 250 | — | — | 0.8 | UNPLATED |
| | | 8 | 300 | — | — | 0.8 | PLATED |
| | | 9 | 5 | 550 | 25 | 0.8 | PLATED |
| | D | 10 | 280 | — | — | 0.6 | UNPLATED |
| | | 11 | 300 | 530 | 25 | 0.6 | PLATED |
| | | 12 | 300 | 550 | 30 | 1.0 | PLATED |
| | E | 13 | 280 | — | — | 0.6 | PLATED |
| | | 14 | 270 | 540 | 25 | 0.6 | PLATED |
| | | 15 | 350 | 520 | 30 | 0.8 | PLATED |
| | F | 16 | 330 | 550 | 20 | 0.7 | PLATED |
| | | 17 | 320 | — | — | 0.4 | UNPLATED |
| | | 18 | 300 | 510 | 25 | 0.5 | PLATED |
| | G | 19 | 350 | 530 | 20 | 0.5 | PLATED |
| | | 20 | 280 | 520 | 30 | 0.9 | PLATED |
| | | 21 | 300 | 520 | 15 | 0.7 | PLATED |
| | H | 22 | 300 | — | — | 0.8 | PLATED |
| | | 23 | 330 | — | — | 0.8 | UNPLATED |
| | | 24 | 280 | 510 | 20 | 0.7 | PLATED |
| | I | 25 | 390 | 520 | 20 | 0.5 | PLATED |
| | | 26 | 250 | — | — | 0.4 | PLATED |
| | | 27 | 260 | 510 | 20 | 0.8 | PLATED |

(NOTE 1)
THE UNDERLINED VALUES INDICATE VALUES OUTSIDE THE RANGE OF THE PRESENT INVENTION.

TABLE 2-2

| | | HOT ROLLING | | | ANNEALING | | |
|---|---|---|---|---|---|---|---|
| STEEL No. | PRODUCTION No. | HEATING TEMPERATURE ° C. | FINISHING TEMPERATURE ° C. | COILING TEMPERATURE ° C. | MAXIMUM HEATING TEMPERATURE ° C. | HOLDING TIME SEC | HOLDING TEMPERATURE ° C. |
| J | 28 | 1230 | 920 | 580 | 670 | 100 | 450 |
| | 29 | 1230 | 920 | 590 | 670 | 100 | 450 |
| | 30 | 1220 | 930 | 580 | 630 | 250 | 450 |
| K | 31 | 1220 | 900 | 550 | 670 | 110 | 600 |
| | 32 | 1210 | 890 | 550 | 650 | 80 | 450 |

TABLE 2-2-continued

| | | | | | | | |
|---|---|---|---|---|---|---|---|
| | 33 | 1220 | 900 | 530 | 650 | 100 | 450 |
| | 34 | 1200 | 900 | 700 | 680 | 90 | 460 |
| L | 35 | 1210 | 920 | 530 | 640 | 120 | 480 |
| | 36 | 1200 | 910 | 520 | 670 | 120 | 420 |
| | 37 | 1250 | 900 | 520 | 640 | 110 | 400 |
| | 38 | 1200 | 880 | 300 | 660 | 95 | 440 |
| M | 39 | 1240 | 940 | 580 | 630 | 150 | 450 |
| N | 40 | 1220 | 900 | 560 | 650 | 100 | 450 |
| O | 41 | 1220 | 930 | 420 | 670 | 100 | 420 |
| P | 42 | 1260 | 950 | 550 | 610 | 120 | 450 |
| Q | 43 | 1200 | 900 | 550 | 660 | 80 | 500 |
| R | 44 | 1270 | 910 | 570 | 700 | 110 | 450 |
| S | 45 | 1200 | 900 | 580 | 680 | 80 | 420 |
| T | 46 | 1250 | 930 | 550 | 690 | 130 | 450 |
| U | 47 | 1200 | 920 | 450 | 650 | 80 | 500 |
| V | 48 | 1200 | 900 | 550 | 670 | 80 | 500 |
| W | 49 | 1220 | 920 | 450 | 650 | 100 | 420 |
| X | 50 | 1220 | 920 | 480 | 650 | 120 | 430 |
| Y | 51 | 1200 | 900 | 550 | 650 | 100 | 450 |
| Z | 52 | 1220 | 930 | 580 | 680 | 100 | 420 |
| AA | 53 | 1200 | 900 | 550 | 670 | 120 | 450 |

| | | | ANNEALING | | | SKIN PASS | |
|---|---|---|---|---|---|---|---|
| | STEEL No. | PRODUCTION No. | HOLDING TIME SEC | ALLOYING TREATMENT TEMPERATUR ° C. | ALLOYING TREATMENT TIME SEC | ROLLING AFTER ANNEALING ELONGATION RATIO % | ZINC PLATING |
| | J | 28 | 400 | — | — | 0.8 | UNPLATED |
| | | 29 | 350 | 540 | 15 | 0.8 | PLATED |
| | | 30 | 350 | 510 | 20 | 0.7 | PLATED |
| | K | 31 | 330 | — | — | 0.6 | UNPLATED |
| | | 32 | 320 | 520 | 30 | 0.7 | PLATED |
| | | 33 | 300 | 550 | 25 | 0.4 | PLATED |
| | | 34 | 280 | 530 | 20 | 0.6 | PLATED |
| | L | 35 | 600 | 520 | 25 | 0.5 | PLATED |
| | | 36 | 300 | — | — | 0.6 | UNPLATED |
| | | 37 | 350 | 530 | 20 | 0.4 | PLATED |
| | | 38 | 290 | 540 | 25 | 0.6 | PLATED |
| | M | 39 | 300 | 550 | 20 | 0.3 | PLATED |
| | N | 40 | 280 | — | — | 0.8 | PLATED |
| | O | 41 | 280 | 550 | 25 | 0.8 | PLATED |
| | P | 42 | 300 | 520 | 25 | 1.2 | PLATED |
| | Q | 43 | 300 | 550 | 30 | 0.6 | PLATED |
| | R | 44 | 300 | — | — | 0.5 | PLATED |
| | S | 45 | 270 | 550 | 35 | 0.8 | PLATED |
| | T | 46 | 300 | 510 | 30 | 0.6 | PLATED |
| | U | 47 | 270 | — | — | 0.8 | UNPLATED |
| | V | 48 | 260 | 540 | 30 | 1.0 | PLATED |
| | W | 49 | 300 | 550 | 30 | 1.0 | PLATED |
| | X | 50 | 250 | 540 | 35 | 0.8 | PLATED |
| | Y | 51 | 300 | 520 | 20 | 0.6 | PLATED |
| | Z | 52 | 350 | — | — | 0.8 | UNPLATED |
| | AA | 53 | 300 | 550 | 30 | 0.6 | PLATED |

(NOTE 1)
THE UNDERLINED VALUES INDICATE VALUES OUTSIDE THE RANGE OF THE PRESENT INVENTION.

TABLE 3-1

| | | MICROSTRUCTURE | | | CEMENTITE | | MECHANICAL PROPERTIES | |
|---|---|---|---|---|---|---|---|---|
| STEEL No. | PRODUCTION No. | FERRITE AREA FRACTION % | BAINITE AREA FRACTION % | TOTAL FRACTION OF OTHER PHASES % | EQUIVALENT CIRCLE DIAMETER μm | NUMBER DENSITY PARTICLE/ $\mu m^2$ | YIELD STRENGTH YP MPa | TENSILE STRENGTH TS MPa |
| A | 1 | 88 | 12 | 0 | 0.205 | 0.08 | 560 | 620 |
| | 2 | 86 | 14 | 0 | 0.195 | 0.08 | 550 | 605 |
| | 3 | 89 | 11 | 0 | 0.175 | 0.10 | 430 | 560 |
| B | 4 | 86 | 14 | 0 | 0.250 | 0.10 | 540 | 615 |
| | 5 | 89 | 11 | 0 | 0.220 | 0.07 | 530 | 605 |
| | 6 | 88 | 12 | 0 | 0.320 | 0.08 | 550 | 610 |
| C | 7 | 89 | 11 | 0 | 0.155 | 0.10 | 540 | 610 |
| | 8 | 90 | 10 | 0 | 0.225 | 0.10 | 530 | 600 |
| | 9 | 88 | 12 | 0 | 0.320 | 0.08 | 540 | 610 |

TABLE 3-1-continued

| | | | | | | | | |
|---|---|---|---|---|---|---|---|---|
| D | 10 | 88 | 12 | 0 | 0.180 | 0.06 | 555 | 625 |
| | 11 | 86 | 14 | 0 | 0.175 | 0.10 | 555 | 620 |
| | 12 | 86 | 14 | 0 | 0.160 | 0.10 | 620 | 660 |
| E | 13 | 89 | 11 | 0 | 0.200 | 0.08 | 540 | 610 |
| | 14 | 89 | 11 | 0 | 0.170 | 0.09 | 560 | 630 |
| | 15 | 95 | 5 | 0 | 0.165 | 0.10 | 410 | 550 |
| F | 16 | 82 | 17 | 1 | 0.180 | 0.10 | 580 | 640 |
| | 17 | 88 | 12 | 0 | 0.200 | 0.10 | 560 | 620 |
| | 18 | 70 | 28 | 2 | 0.205 | 0.08 | 600 | 700 |
| G | 19 | 87 | 13 | 0 | 0.195 | 0.08 | 555 | 630 |
| | 20 | 90 | 10 | 0 | 0.200 | 0.10 | 540 | 620 |
| | 21 | 87 | 13 | 0 | 0.185 | 0.09 | 420 | 555 |
| H | 22 | 89 | 11 | 0 | 0.175 | 0.10 | 525 | 610 |
| | 23 | 87 | 13 | 0 | 0.180 | 0.10 | 530 | 615 |
| | 24 | 84 | 15 | 1 | 0.150 | 0.10 | 420 | 570 |
| I | 25 | 88 | 12 | 0 | 0.220 | 0.10 | 550 | 610 |
| | 26 | 88 | 12 | 0 | 0.230 | 0.08 | 550 | 605 |
| | 27 | 88 | 12 | 0 | 0.140 | 0.10 | 430 | 575 |

| | | | MECHANICAL PROPERTIES | | | | | |
|---|---|---|---|---|---|---|---|---|
| | STEEL No. | PRODUCTION No. | TOTAL ELONGATION El % | YIELD RATIO | TS × El MPa · % | FATIGUE STRENGTH MPa | FATIGUE STRENGTH RATIO | HOLE EXPANSION RATIO λ % |
| | A | 1 | 28 | 0.90 | 17360 | 330 | 0.53 | 120 |
| | | 2 | 29 | 0.91 | 17545 | 320 | 0.53 | 110 |
| | | 3 | 30 | 0.77 | 16800 | 240 | 0.43 | 100 |
| | B | 4 | 29 | 0.88 | 17835 | 300 | 0.49 | 105 |
| | | 5 | 30 | 0.88 | 18150 | 300 | 0.50 | 110 |
| | | 6 | 29 | 0.90 | 17690 | 300 | 0.49 | 70 |
| | C | 7 | 29 | 0.89 | 17690 | 300 | 0.49 | 110 |
| | | 8 | 30 | 0.88 | 18000 | 300 | 0.50 | 105 |
| | | 9 | 29 | 0.89 | 17690 | 300 | 0.49 | 70 |
| | D | 10 | 28 | 0.89 | 17500 | 300 | 0.48 | 120 |
| | | 11 | 28 | 0.90 | 17360 | 310 | 0.50 | 110 |
| | | 12 | 26 | 0.94 | 17160 | 270 | 0.41 | 100 |
| | E | 13 | 29 | 0.89 | 17690 | 320 | 0.52 | 130 |
| | | 14 | 28 | 0.89 | 17640 | 310 | 0.49 | 130 |
| | | 15 | 32 | 0.75 | 17600 | 240 | 0.44 | 150 |
| | F | 16 | 27 | 0.91 | 17280 | 320 | 0.50 | 100 |
| | | 17 | 28 | 0.90 | 17360 | 325 | 0.52 | 110 |
| | | 18 | 23 | 0.86 | 16100 | 350 | 0.50 | 65 |
| | G | 19 | 28 | 0.88 | 17640 | 310 | 0.49 | 95 |
| | | 20 | 28 | 0.87 | 17360 | 330 | 0.53 | 105 |
| | | 21 | 31 | 0.76 | 17205 | 230 | 0.41 | 120 |
| | H | 22 | 29 | 0.86 | 17690 | 300 | 0.49 | 140 |
| | | 23 | 29 | 0.86 | 17835 | 300 | 0.49 | 130 |
| | | 24 | 30 | 0.74 | 17100 | 240 | 0.42 | 150 |
| | I | 25 | 29 | 0.90 | 17690 | 310 | 0.51 | 120 |
| | | 26 | 29 | 0.91 | 17545 | 310 | 0.51 | 120 |
| | | 27 | 30 | 0.75 | 17250 | 240 | 0.42 | 130 |

(NOTE 1)
THE UNDERLINED VALUES INDICATE VALUES OUTSIDE THE RANGE OF THE PRESENT INVENTION.

TABLE 3-2

| | | MICROSTRUCTURE | | | CEMENTITE | | MECHANICAL PROPERTIES | |
|---|---|---|---|---|---|---|---|---|
| STEEL No. | PRODUCTION No. | FERRITE AREA FRACTION % | BAINITE AREA FRACTION % | TOTAL FRACTION OF OTHER PHASES % | EQUIVALENT CIRCLE DIAMETER μm | NUMBER DENSITY PARTICLE/ $\mu m^2$ | YIELD STRENGTH YP MPa | TENSILE STRENGTH TS MPa |
| J | 28 | 89 | 11 | 0 | 0.215 | 0.09 | 550 | 615 |
| | 29 | 90 | 10 | 0 | 0.210 | 0.10 | 545 | 615 |
| | 30 | 89 | 11 | 0 | 0.210 | 0.10 | 415 | 565 |
| K | 31 | 87 | 13 | 0 | 0.350 | 0.20 | 545 | 620 |
| | 32 | 87 | 13 | 0 | 0.210 | 0.10 | 560 | 615 |
| | 33 | 85 | 15 | 0 | 0.205 | 0.10 | 565 | 620 |
| | 34 | 98 | 2 | 0 | 0.280 | 0.10 | 500 | 575 |
| L | 35 | 83 | 17 | 0 | 0.335 | 0.20 | 560 | 635 |
| | 36 | 82 | 18 | 0 | 0.175 | 0.09 | 560 | 625 |
| | 37 | 82 | 18 | 0 | 0.165 | 0.07 | 580 | 630 |
| | 38 | 85 | 10 | 5 | 0.105 | 0.10 | 450 | 680 |

TABLE 3-2-continued

| | | | | | | | | |
|---|---|---|---|---|---|---|---|---|
| M | 39 | 88 | 12 | 0 | 0.205 | 0.10 | 620 | 720 |
| N | 40 | 100 | 0 | 0 | 0.200 | 0.10 | 380 | 540 |
| O | 41 | 96 | 3 | 1 | 0.180 | 0.08 | 530 | 585 |
| P | 42 | 100 | 0 | 0 | 0.205 | 0.08 | 540 | 580 |
| Q | 43 | 70 | 30 | 0 | 0.255 | 0.10 | 630 | 730 |
| R | 44 | 75 | 25 | 0 | 0.205 | 0.07 | 590 | 670 |
| S | 45 | 97 | 3 | 0 | 0.170 | 0.08 | 500 | 585 |
| T | 46 | 87 | 13 | 0 | 0.205 | 0.10 | 430 | 570 |
| U | 47 | 84 | 16 | 0 | 0.250 | 0.09 | 420 | 600 |
| V | 48 | 88 | 12 | 0 | 0.245 | 0.09 | 620 | 690 |
| W | 49 | 84 | 16 | 0 | 0.165 | 0.10 | 420 | 600 |
| X | 50 | 85 | 15 | 0 | 0.165 | 0.10 | 620 | 690 |
| Y | 51 | 86 | 14 | 0 | 0.205 | 0.08 | 440 | 585 |
| Z | 52 | 87 | 13 | 0 | 0.175 | 0.10 | 690 | 750 |
| AA | 53 | 86 | 14 | 0 | 0.195 | 0.10 | 620 | 700 |

| | | MECHANICAL PROPERTIES | | | | | |
|---|---|---|---|---|---|---|---|
| STEEL No. | PRODUCTION No. | TOTAL ELONGATION El % | YIELD RATIO | TS × El MPa · % | FATIGUE STRENGTH MPa | FATIGUE STRENGTH RATIO | HOLE EXPANSION RATIO λ % |
| J | 28 | 29 | 0.89 | 17835 | 330 | 0.54 | 125 |
| | 29 | 29 | 0.89 | 17835 | 320 | 0.52 | 130 |
| | 30 | 31 | 0.73 | 17515 | 230 | 0.41 | 145 |
| K | 31 | 28 | 0.88 | 17360 | 310 | 0.50 | 60 |
| | 32 | 28 | 0.91 | 17220 | 320 | 0.52 | 115 |
| | 33 | 28 | 0.91 | 17360 | 300 | 0.48 | 105 |
| | 34 | 30 | 0.87 | 17250 | 290 | 0.50 | 120 |
| L | 35 | 28 | 0.88 | 17780 | 330 | 0.52 | 60 |
| | 36 | 28 | 0.90 | 17500 | 330 | 0.53 | 130 |
| | 37 | 27 | 0.92 | 17010 | 320 | 0.51 | 130 |
| | 38 | 24 | 0.66 | 16320 | 400 | 0.59 | 50 |
| M | 39 | 22 | 0.86 | 15840 | 340 | 0.47 | 60 |
| N | 40 | 30 | 0.70 | 16200 | 260 | 0.48 | 100 |
| O | 41 | 28 | 0.91 | 16380 | 300 | 0.51 | 120 |
| P | 42 | 28 | 0.93 | 16240 | 300 | 0.52 | 150 |
| Q | 43 | 22 | 0.86 | 16060 | 350 | 0.48 | 60 |
| R | 44 | 24 | 0.88 | 16080 | 320 | 0.48 | 70 |
| S | 45 | 28 | 0.85 | 16380 | 300 | 0.51 | 100 |
| T | 46 | 29 | 0.75 | 16530 | 240 | 0.42 | 70 |
| U | 47 | 30 | 0.70 | 18000 | 300 | 0.50 | 70 |
| V | 48 | 23 | 0.90 | 15870 | 340 | 0.49 | 70 |
| W | 49 | 30 | 0.70 | 18000 | 300 | 0.50 | 70 |
| X | 50 | 23 | 0.90 | 15870 | 340 | 0.49 | 70 |
| Y | 51 | 30 | 0.75 | 17550 | 250 | 0.43 | 90 |
| Z | 52 | 21 | 0.92 | 15750 | 370 | 0.49 | 60 |
| AA | 53 | 22 | 0.89 | 15400 | 360 | 0.51 | 60 |

(NOTE 1)
THE UNDERLINED VALUES INDICATE VALUES OUTSIDE THE RANGE OF THE PRESENT INVENTION.

The invention claimed is:

1. A steel sheet comprising, by mass %:

C: 0.020% or more and 0.080% or less;

Si: 0.01% or more and 0.10% or less;

Mn: 0.80% or more and 1.80% or less;

Al: more than 0.10% and less than 0.40%;

Mo: 0% or more and 1.000% or less;

W: 0% or more and 1.000% or less;

V: 0% or more and 1.000% or less;

B: 0% or more and 0.0100% or less;

Ni: 0% or more and 1.50% or less;

Cu: 0% or more and 1.50% or less;

Cr: 0% or more and 1.50% or less;

P: limited to 0.0100% or less;

S: limited to 0.0150% or less;

N: limited to 0.0100% or less;

Nb: 0.005% or more and 0.095% or less;

Ti: 0.005% or more and 0.095% or less; and a balance comprising Fe and unavoidable impurities, wherein:

a total amount of Nb and Ti is 0.030% or more and 0.100% or less, a metallographic structure of the steel sheet includes ferrite, bainite, and other phases, the other phases include a pearlite, a residual austenite, and a martensite, an area fraction of the ferrite is 80% or more and 95% or less, an area fraction of the bainite is 5% or more and 20% or less, a total fraction of the other phases is less than 3%, an equivalent circle diameter of a cementite in the ferrite is 0.003 μm or more and 0.300 μm or less, a number density of the cementite in the ferrite is 0.02 particles/$\mu m^2$ or more and 0.10 particles/$\mu m^2$ or less, a tensile strength is 590 MPa or more, and a fatigue strength ratio as a fatigue strength to the tensile strength is 0.45 or more.

2. The steel sheet according to claim 1, comprising one or two more of, by mass %:

Mo: 0.005% or more and 1.000% or less;

W: 0.005% or more and 1.000% or less;

V: 0.005% or more and 1.000% or less;

B: 0.0005% or more and 0.0100% or less;

Ni: 0.05% or more and 1.50% or less;

Cu: 0.05% or more and 1.50% or less; and

Cr: 0.05% or more and 1.50% or less.

3. A plated steel sheet, in which a plating is provided on a surface of the steel sheet according to claim 1.

4. A plated steel sheet, in which a plating is provided on a surface of the steel sheet according to claim 2.

5. A method for producing the steel sheet according to claim 1, the method comprising:

heating a slab having a chemical composition according to claim 1 to 1150° C. or higher before the slab is hot-rolled;

finishing finish rolling at a temperature of $Ar_3$° C. or higher;

pickling a hot-rolled steel sheet which is coiled within a temperature range of 400° C. or higher and 600° C. or lower;

heating the hot-rolled steel sheet within a temperature range of 600° C. or higher and $Ac_1$° C. or lower;

annealing the hot-rolled steel sheet for a holding time, in which the temperature of the hot-rolled steel sheet is within the temperature range for 10 seconds or longer and 200 seconds or shorter;

cooling the steel sheet to 350° C. or higher and 550° C. or lower; and cooling the steel sheet after holding the steel sheet for the holding time, in which the temperature of the hot-rolled steel sheet is within a temperature range of 350° C. or higher and 550° C. or lower for 10 seconds or longer and 500 seconds or shorter, wherein the $Ar_3$° C. and the $Ac_1$° C. are a $Ar_3$ transformation temperature and a $Ac_1$ transformation temperature, respectively, obtained from expressions 1 and 2, $$Ar_3=910-325\times[C]+33\times[Si]+287\times[P]+40\times[Al]-92\times([Mn]+[Mo]+[Cu])-46\times([Cr]+[Ni]) \quad \text{(Expression 1)},$$

$$Ac_1=761.3+212\times[C]-45.8\times[Mn]+16.7\times[Si] \quad \text{Expression 2), and}$$

elements noted in brackets represent an amount of the elements by mass %.

6. The method for producing a steel sheet according to claim 5, further comprising:

carrying out skin pass rolling on the steel sheet at an elongation ratio of 0.4% or more and 2.0% or less.

7. A method for producing a plated steel sheet comprising:

plating and then cooling the steel sheet after the annealing, the cooling, and the holding according to claim 5.

8. The method for producing a plated steel sheet according to claim 7, further comprising:

carrying out a heat treatment within a temperature range of 450° C. or higher and 600° C. or lower for 10 seconds or longer and then cooling the steel sheet after the plating.

9. A method for producing a plated steel sheet comprising:

plating and then cooling the steel sheet after the annealing, the cooling, and the holding according to claim 6.

10. The method for producing a plated steel sheet according to claim 9, further comprising:

carrying out a heat treatment within a temperature range of 450° C. or higher and 600° C. or lower for 10 seconds or longer and then cooling the steel sheet after the plating.

* * * * *